US010891923B2

(12) United States Patent
Okazaki et al.

(10) Patent No.: US 10,891,923 B2
(45) Date of Patent: Jan. 12, 2021

(54) VIBRATOR AND MUSICAL INSTRUMENT

(71) Applicant: YAMAHA CORPORATION, Hamamatsu (JP)

(72) Inventors: Masatsugu Okazaki, Hamamatsu (JP); Ichiro Osuga, Hamamatsu (JP); Banri Abe, Hamamatsu (JP); Shinji Sumino, Hamamatsu (JP); Takashi Kitagawa, Hamamatsu (JP); Takuya Abe, Kakegawa (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/675,533

(22) Filed: Nov. 6, 2019

(65) Prior Publication Data

US 2020/0152160 A1 May 14, 2020

(30) Foreign Application Priority Data

Nov. 9, 2018 (JP) ..... 2018-211240

(51) Int. Cl.
*G10C 3/20* (2006.01)
*B06B 1/04* (2006.01)

(52) U.S. Cl.
CPC ..... *G10C 3/20* (2013.01); *B06B 1/045* (2013.01)

(58) Field of Classification Search
CPC ..... G10C 3/20; B06B 1/045
See application file for complete search history.

(56) References Cited

U.S. PATENT DOCUMENTS 1,037,349 A * 9/1912 Smith ..... G10C 3/20 84/19
3,581,254 A * 5/1971 Cannon ..... G10C 3/20 335/255
3,581,255 A * 5/1971 Cannon et al. ..... G10C 3/20 335/255
4,031,796 A * 6/1977 Wilkes ..... G10C 3/20 84/20
4,156,380 A * 5/1979 Fulton ..... G10C 3/20 84/171
4,741,237 A * 5/1988 Murakami ..... G10F 1/02 84/20
6,965,679 B1 * 11/2005 Lopez Bosio ..... H04R 1/028 381/152
7,085,391 B1 * 8/2006 Yamaya ..... G10H 1/32 381/118
8,383,920 B2 * 2/2013 Komatsu ..... G10C 3/20 84/17
8,859,866 B2 * 10/2014 Onishi ..... G10C 3/06 84/174

(Continued)

FOREIGN PATENT DOCUMENTS

WO 2014115482 A1 7/2014

*Primary Examiner* — Robert W Horn
(74) *Attorney, Agent, or Firm* — Rossi, Kimms & McDowell LLP

(57) ABSTRACT

A vibrator includes: a movable portion connected to a vibratable member; a driver configured to drive the movable portion to cause vibration of the movable portion to vibrate the vibratable member; and a driver supporter secured to a support member and configured to support the driver such that the driver is pivotable about an axis extending in a direction intersecting a movable direction of the movable portion.

18 Claims, 10 Drawing Sheets

(56) References Cited

U.S. PATENT DOCUMENTS

| | | | | |
|---|---|---|---|---|
| 8,962,966 | B2 * | 2/2015 | Ohnishi | G10C 3/06 84/13 |
| 9,373,314 | B2 * | 6/2016 | Takahashi | G10H 1/32 |
| 9,779,711 | B2 * | 10/2017 | Ohnishi | G10D 3/02 |
| 9,779,712 | B2 * | 10/2017 | Ohnishi | G10H 3/146 |
| 2015/0163571 | A1 * | 6/2015 | Satomi | H04R 1/025 381/162 |
| 2015/0356961 | A1 | 12/2015 | Takahashi | |
| 2016/0035331 | A1 * | 2/2016 | Murakami | G10C 3/06 84/726 |

* cited by examiner

VIBRATOR AND MUSICAL INSTRUMENT

CROSS REFERENCE TO RELATED APPLICATION

The present application claims priority from Japanese Patent Application No. 2018-211240, which was filed on Nov. 9, 2018, the disclosure of which is herein incorporated by reference in its entirety.

BACKGROUND

The following disclosure relates to a vibrator including a driver configured to drive a movable portion to vibrate a vibratable member using vibrations of the movable portion, and to a musical instrument provided with the vibrator.

There is conventionally known an apparatus, such as a musical instrument, provided with a vibrating member that vibrates a vibratable member. The vibrating member is, for example, operated by an audio signal to vibrate the vibratable member, thereby producing sounds from the vibratable member. In a keyboard instrument, for example, the vibrating member is secured to a straight pole via a support member, and a movable portion is connected to a sound board as the vibratable member. The movable portion is vibrated by an input of a current related to the audio signal to a coil. The vibrations of the movable portion are transmitted to the sound board, and vibrations of the sound board produce sounds. Patent Document 1 (WO2014/115482) discloses a mounting structure of a vibrating member including a movable portion and a driver. In the structure, the movable portion is electromagnetically engaged with a magnetic-path definer (the driver) including a magnet and a core. When a current is applied to the coil of the movable portion, the movable portion vibrates by its reciprocation in the axial direction of the movable portion. A distal end portion of the movable portion is coupled and secured to a sound board.

A lapse of time may deform a vibratable member such as the sound board and change the diameter of the vibratable member due to a temperature and humidity. A position at which the movable portion is coupled to the vibratable member moves with deformation or movement of the vibratable member. Increase in the movement of the position in some degree may cause the movable portion and the magnetic-path definer to physically interfere with each other or to be inappropriately engaged with each other electromagnetically. This leads to a possibility that the movable portion does not operate well, and a vibrating function of the vibrating member is not maintained. Inappropriate transmission of vibrations leads to inappropriate production of sounds. Thus, if a positional relationship between the movable portion and the driver becomes inappropriate due to deformation or movement of the vibratable member, a damper connecting between the movable portion and the driver may be deformed, and driving becomes unstable, leading to lower durability of the vibrating member. It is noted that an error in the position at which the movable portion is coupled to the vibratable member is in some cases caused during mounting of the vibrating member.

To solve these problems, the movable portion in Patent Document 1 has a function of absorbing movement of the distal end portion of the movable portion in the horizontal direction perpendicular to the direction of the vibration of the movable portion. In Patent Document 1, a mechanism for absorbing movement of the driver in the horizontal direction is provided in a relationship between the driver and a portion supporting the driver (FIG. 10).

SUMMARY

However, the deformation of the vibratable member may be in some cases caused as an inclination of the vibratable member. That is, an angle of a normal line, which is normal to the vibratable member, with respect to the movable direction of the movable portion (which coincides with the direction of the vibration of the movable portion and a direction in which the axis of the magnetic-path definer extends) is different from a target angle (e.g., zero degrees) in some cases. In the mounting structure of the conventional vibrating member, since the movable portion is in most cases secured to the vibratable member, the position and the orientation of a portion of the movable portion which is secured to the vibratable member principally depend on the vibratable member. Also, since the driver is usually secured to the support member, the position and the orientation of the driver are fixed. Thus, if a line normal to a portion of the vibratable member to which the movable portion is secured in particular is inclined, there is a possibility that the angle between the movable direction of the movable portion and the direction normal to the vibratable member becomes different from the designed target angle. When the angle between the movable direction of the movable portion and the direction normal to the vibratable member becomes different from the target angle, there is a possibility that an excessive force is generated between the movable portion and the driver. The angle becomes different from the target angle due to a manufacturing error or a mounting error in a relationship between the driver and the support member, for example. The mounting structure in Patent Document 1 includes the mechanism for absorbing movement of the driver in the horizontal direction. However, it is impossible to absorb the difference in the angle between the movable direction of the movable portion and the direction normal to the vibratable member.

Accordingly, an aspect of the disclosure relates to a vibrator and a musical instrument capable of improving durability.

In one aspect of the disclosure, a vibrator includes: a movable portion connected to a vibratable member; a driver configured to drive the movable portion to cause vibration of the movable portion to vibrate the vibratable member; and a driver supporter secured to a support member and configured to support the driver such that the driver is pivotable about an axis extending in a direction intersecting a movable direction of the movable portion.

Effects

The configuration described above improves durability.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Hereinafter, there will be described embodiments by reference to the drawings.

First Embodiment

Figure 1:
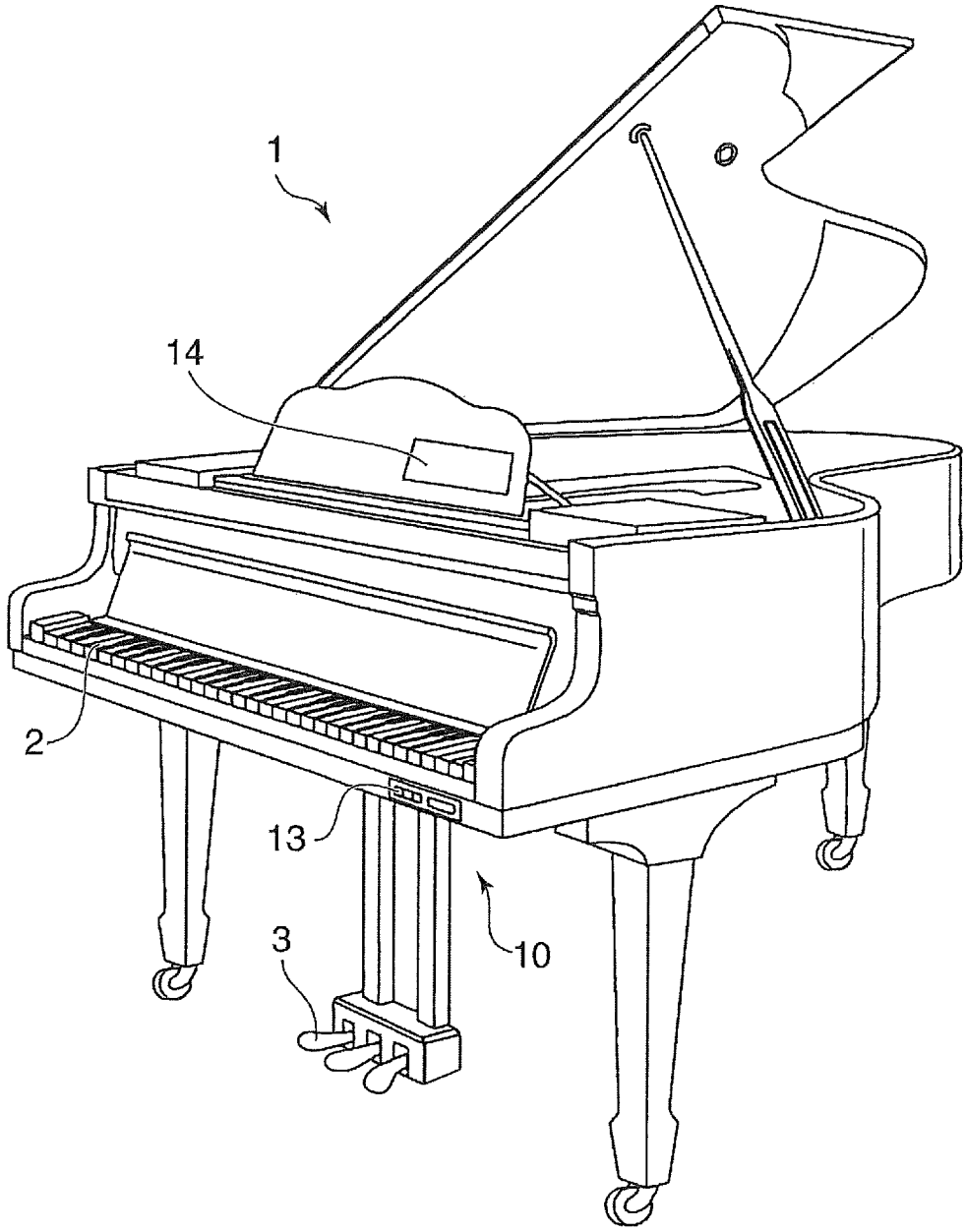
FIG. 1 is a perspective view of an external appearance of a musical instrument to which a vibrator according to a first embodiment is applied.

FIG. 1 is a perspective view of an external appearance of a vibrator according to a first embodiment and a musical instrument to which the vibrator is applied. In the present embodiment, a piano 1 in the form of a ground piano is one example of the vibrator operable by an audio signal to produce a sound by vibrating a vibratable member, and an apparatus and a musical instrument to which the vibrator is applied. A sound board 7 is one example of the vibratable member. However, the vibrator and the vibratable member are not limited to those, and any elements may be employed as long as a vibrating member is driven by a drive signal to vibrate a vibratable member.

The piano 1 includes a keyboard and pedals 3. The keyboard includes a plurality of keys 2 arranged at a front portion of the piano 1. A player performs a playing operation with the keys 2. The piano 1 further includes a controller 10 and a touch screen 14. The controller 10 is provided at a front surface of the piano 1 and includes an operation panel 13. The touch screen 14 is provided at a music stand. The player operates the operation panel 13 and the touch screen 14 to input an instruction to the controller 10.

Figure 2:
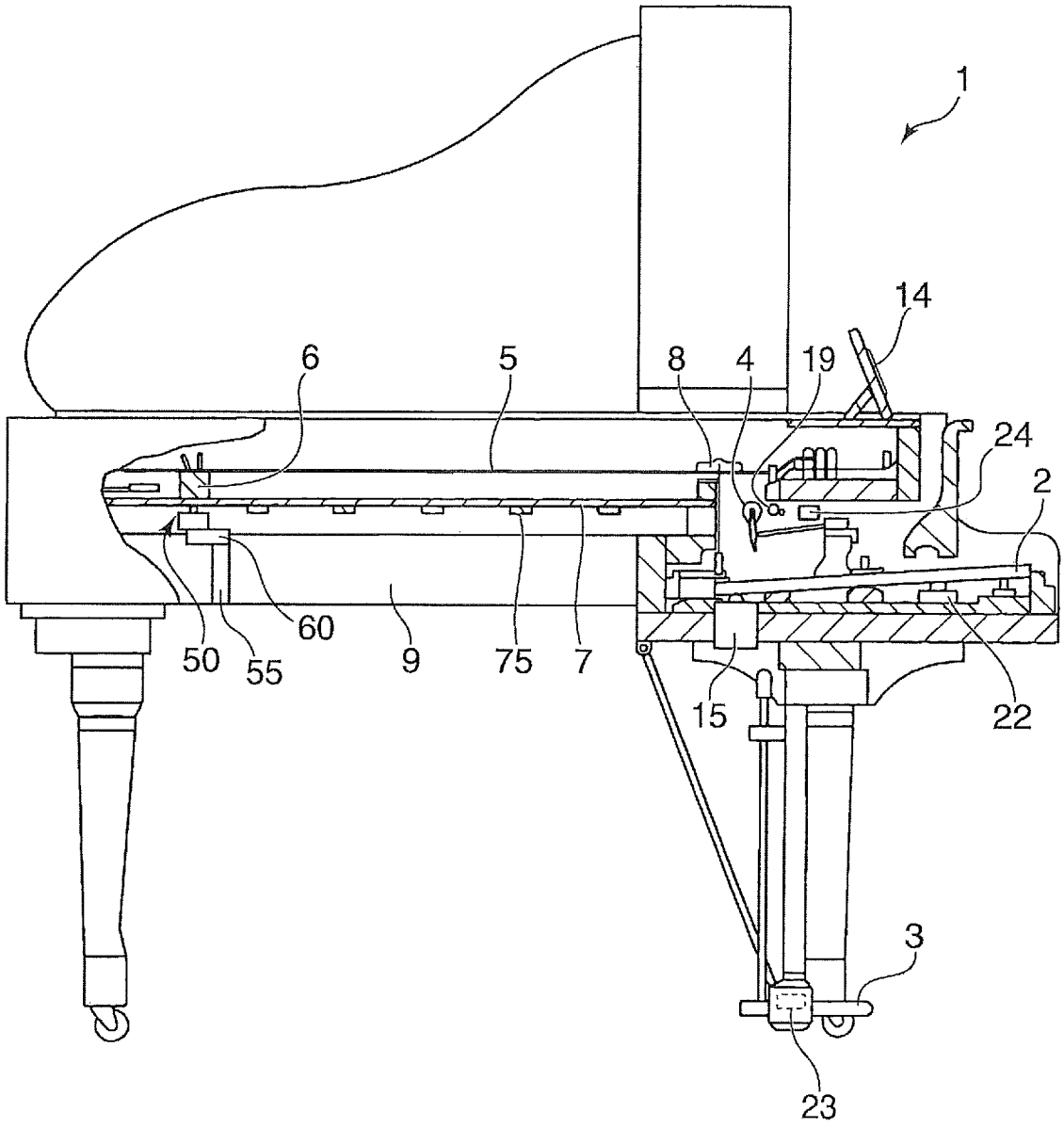
FIG. 2 is a cross-sectional view of an internal structure of a piano.

FIG. 2 is a cross-sectional view of an internal structure of the piano 1. In FIG. 2, a configuration corresponding to each of the keys 2 is illustrated for one of the keys 2, without illustrating configurations corresponding to the other keys 2. It is noted that the following description will be provided for each key for simplicity unless otherwise required. A key driver 15 configured to drive the key 2 using a solenoid is provided at a lower portion of a rear end of the keys 2 (i.e., a back portion of the key 2 when viewed from the player). The key driver 15 drives the solenoid to raise a plunger based on a control signal transmitted from the controller 10 and thereby reproduces a state that is similar to a state in which the key 2 is pressed by the player. The key driver 15 lowers the plunger to reproduce a state that is similar to a state in which the key 2 is released by the player.

A string 5 and a hammer 4 is provided for the key 2. When the key 2 is pressed, the hammer 4 pivots via an action mechanism, not illustrated, to strike the string 5. A damper 8 is moved in accordance with an amount of pressing of the key 2 and an amount of pressing of a damper pedal of the pedals 3, thereby switching a state of the damper 8 between a state in which the damper 8 is not in contact with the string 5 and a state in which the damper 8 is in contact with the string 5. In the following description, the words "the pedal 3" represent the damper pedal. A stopper 19 catches the hammer 4 to stop a strike of the hammer 4 on the string 5. The stopper 19 is operated when a string-strike stopping mode is set.

A key sensor 22 is provided at a lower portion of the key 2 to send the controller 10 a detection signal related to an action of the key 2. A hammer sensor 24 is provided for the hammer 4 to send the controller 10 a detection signal related to an action of the hammer 4. Pedal sensors 23 are provided for the respective pedals 3. Each of the pedal sensors 23 sends the controller 10 a detection signal related to an action of a corresponding one of the pedals 3. Though not illustrated, the controller 10 includes a CPU, a ROM, a RAM, and a communication interface. The controller 10 executes various controls by the CPU executing control programs stored in the ROM.

The sound board 7 is a plate-like member formed of wood. A plurality of sound rods 75 and bridges 6, 6L are arranged on the sound board 7. Each of the tensioned strings 5 is engaged with a corresponding one of the bridges 6, 6L. Thus, vibration of the sound board 7 is transmitted to each string 5 via the corresponding one of the bridges 6, 6L, and vibration of the string 5 is transmitted to the sound board 7 via the corresponding one of the bridges 6, 6L. Driver supporters 60 are supported by a support member 55 connected to a straight pole 9. Vibrating members 50 are supported by the respective driver supporters 60 and connected to the sound board 7. The support member 55 is formed of metal such as an aluminum material. The straight pole 9 supports the tension of the string 5 with the frame. The straight pole 9 is a portion of the piano 1.

Figure 3:
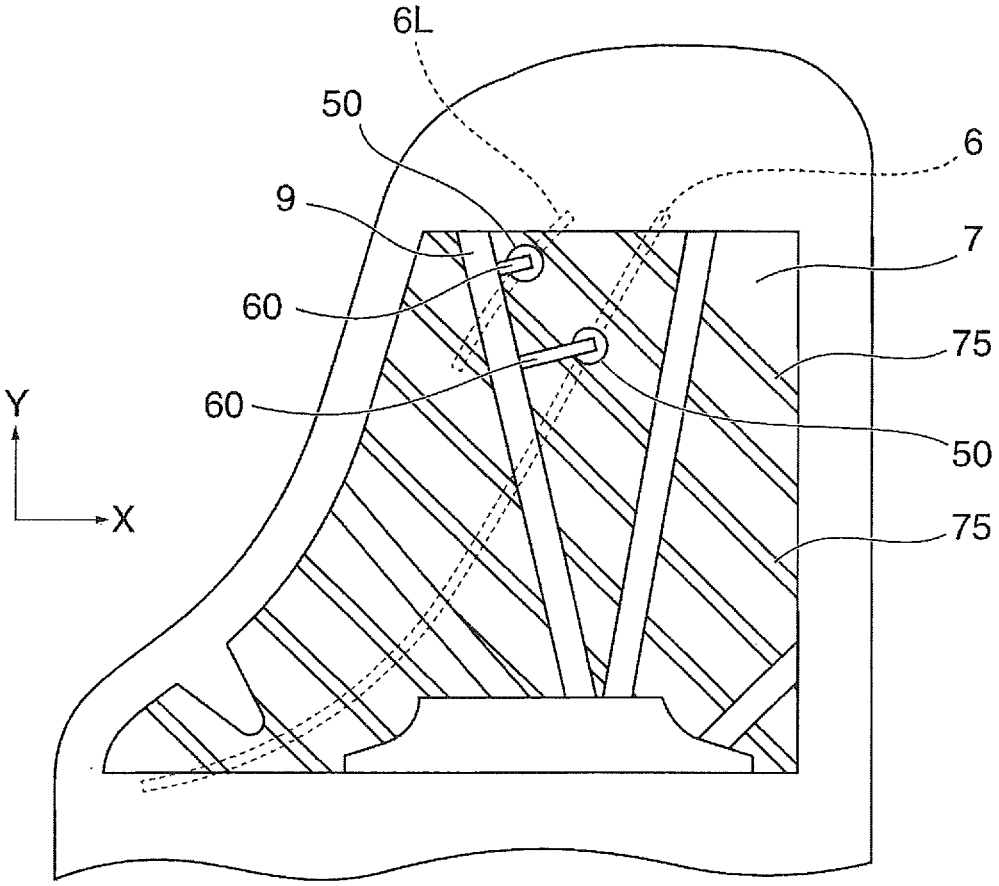
FIG. 3 is a view of a back surface of a sound board for explaining a position at which vibrating members are mounted.

FIG. 3 is a view of a back surface of the sound board 7 for explaining a position at which the vibrating members 50 are mounted. The vibrating members 50 are connected to a portion of the sound board 7 which is located between two of the sound rods 75. The vibrating members 50 have the same configuration. In the present embodiment, two vibrating members 50 are connected to the sound board 7. The number of the vibrating members 50 provided in the piano 1 is not limited and may be one. Each of the vibrating members 50 is disposed as near the bridge 6 or 6L as possible. In the present embodiment, the vibrating member 50 is disposed on an opposite side of the sound board 7 from the bridge 6 or 6L. The right and left direction, the front and rear direction, and the up and down direction of the piano 1 are defined as an X direction, a Y direction, and a Z direction, respectively. The X-Y direction is a horizontal direction.

Figure 4:
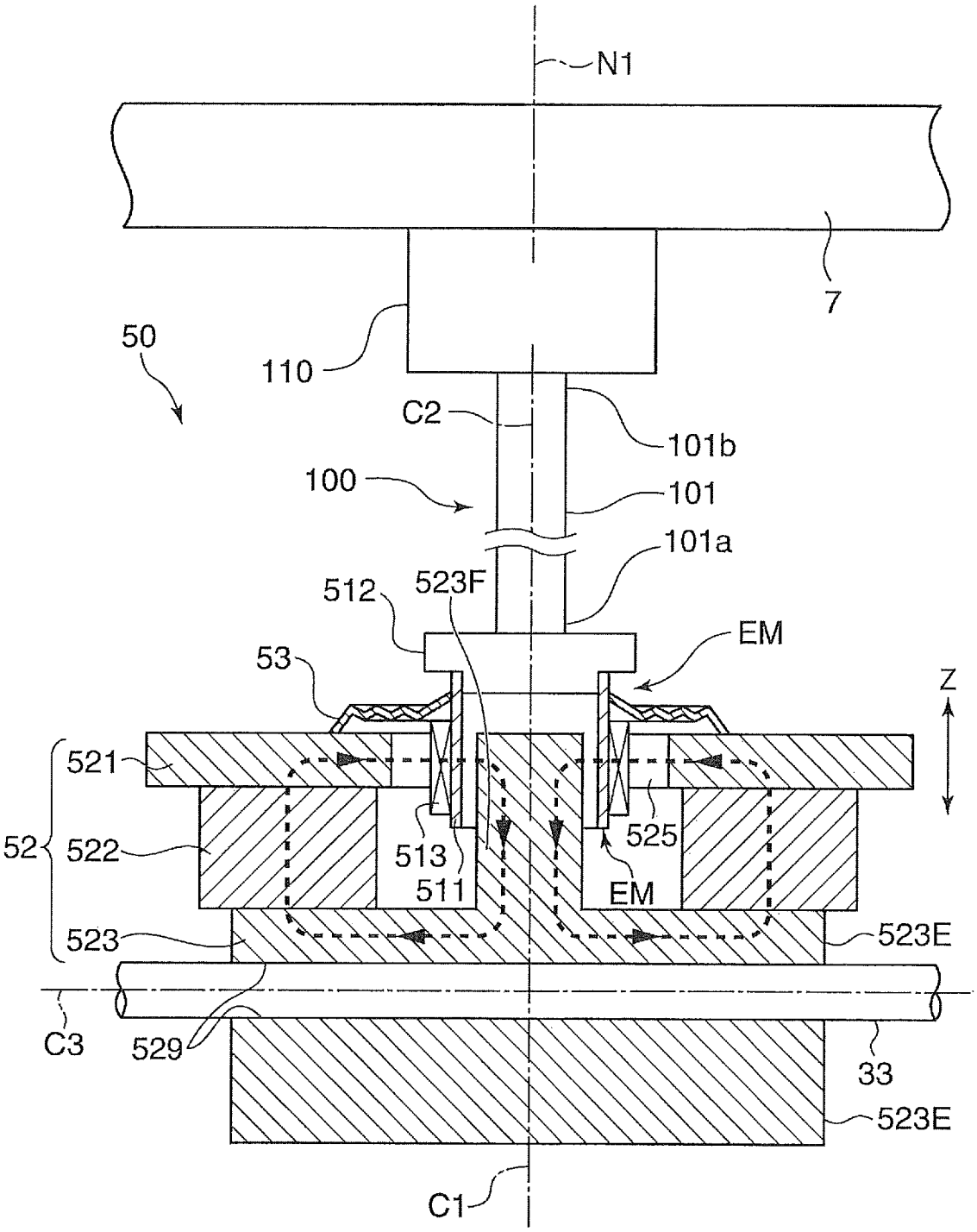
FIG. 4 is an elevational view in vertical cross section illustrating the vibrating member.

FIG. 4 is an elevational view in vertical cross section illustrating the vibrating member 50. Each of the vibrating members 50 is a voice-coil actuator including a magnetic-path definer 52 (as one example of a driver) and a movable member 100 (as one example of a movable portion). The movable member 100 includes a rod-like portion 101, a cap 512, an annular bobbin 511, and a voice coil 513. The bobbin 511 is fitted on and secured to a lower-half portion of the cap 512, with a small space therebetween. The voice coil 513 is constituted by a wire wound around an outer circumferential surface of the bobbin 511. The voice coil 513 converts a current flowing in a magnetic field formed by the magnetic-path definer 52, to vibration. The cap 512, the bobbin 511, and the voice coil 513 constitute an electromagnetic engaging portion EM engaged with the magnetic-path definer 52 electromagnetically.

A lower end portion (one end portion 101*a*) of the rod-like portion 101 is coupled and secured to the cap 512 of the electromagnetic engaging portion EM and extends in the Z direction (in the up and down direction). An other-end-portion coupling portion 110 is secured to a lower surface of the sound board 7. The other-end-portion coupling portion 110 couples and secures an upper end portion (the other end portion 101*b*) of the rod-like portion 101 to the sound board 7 in the Z direction. Thus, the other-end-portion coupling portion 110 functions to transmit vibration of the movable member 100 to the sound board 7.

The magnetic-path definer 52 includes a top plate 521, a magnet 522, and a yoke 523 which are arranged in this order from above. The electromagnetic engaging portion EM is supported by a damper 53 so as to be movable in the Z direction without contact with the magnetic-path definer 52. That is, the damper 53 has a disc shape and is formed of a fiber, for example, and the disc-like portion of the damper 53 is waved like bellows. A circumferentially-outer end portion of the damper 53 is mounted on an upper surface of the top plate 521. A circumferentially-inner end portion of the damper 53 is mounted on the electromagnetic engaging portion EM. The magnetic-path definer 52 is supported by the straight pole 9 by being supported by the support member 55 via the driver supporter 60.

The top plate 521 is, for example, formed of a soft magnetic material such as soft iron and is shaped like a disc having a hole at its center. The yoke 523 is, for example, formed of a soft magnetic material such as soft iron and includes a disc portion 523E and a circular cylindrical portion 523F having an outside diameter that is less than that of the disc portion 523E. The disc portion 523E and the circular cylindrical portion 523F are formed integrally with each other, with their respective axes coinciding with each other. The outside diameter of the circular cylindrical portion 523F is less than the inside diameter of the top plate 521. The magnet 522 is a permanent magnet shaped like a doughnut, and the inside diameter of the magnet 522 is greater than that of the top plate 521. The respective axes of the top plate 521, the magnet 522, and the yoke 523 coincide with each other. These axes serve as the axis C1 of the magnetic-path definer 52. With these arrangements, magnetic paths indicated by broken-line arrows in FIG. 4 are formed. The electromagnetic engaging portion EM is disposed such that the voice coil 513 is located in a magnetic-path space 525 that is a space between the top plate 521 and the circular cylindrical portion 523F. The position of the electromagnetic engaging portion EM in the horizontal direction (the X-Y direction) is determined by the damper 53 such that the axis C2 of the rod-like portion 101 coincides with the axis C1 of the magnetic-path definer 52.

A drive signal based on an audio signal is input from the controller 10 to the vibrating member 50. For example, audio data stored in a storage, not illustrated, is read by the controller 10, and the drive signal is created based on the read audio data. Alternatively, in the case where the sound board 7 is vibrated in response to the playing operation, the controller 10 detects actions of the keys 2, the pedals 3, and the hammers 4 with the key sensors 22, the pedal sensors 23, and the hammer sensors 24 to detect the playing operation of the player. The controller 10 creates playing information based on a result of the detections and creates acoustic signals based on the playing information. Each of the acoustic signals is processed and amplified, and output to the vibrating member 50 as the drive signal.

When the drive signal is input to the voice coil 513, the voice coil 513 receives a magnetic force in the magnetic-path space 525, and the bobbin 511 receives a driving force in the Z direction which is related to a waveform indicated by the input drive signal. Thus, the magnetic-path definer 52 excites the electromagnetic engaging portion EM, thereby vibrating the electromagnetic engaging portion EM and the rod-like portion 101 integrally in the Z direction. When the movable member 100 is vibrated in the Z direction, this vibration is transmitted to the sound board 7 by the other-end-portion coupling portion 110, thereby vibrating the sound board 7. The vibration of the sound board 7 is emitted to air to produce sounds.

The movable direction of the movable member 100 is substantially parallel with the axis C1 of the magnetic-path definer 52. The direction normal to the portion of the sound board 7 to which the other-end-portion coupling portion 110 is secured may be hereinafter referred to as "normal direction N1" or "normal direction N1 of the sound board 7". The normal direction N1 in design coincides with the thickness direction of the sound board 7 in design. In the present embodiment, the axis C1, the axis C2, and the normal direction N1 are parallel with each other in design, and an axis C3 is orthogonal to these axes. However, a lapse of time deforms the sound board 7 and changes the diameter of the sound board 7, for example. Since inclination of the normal direction N1 of the sound board 7 inclines the other-end-portion coupling portion 110, there is a possibility that the angle between the movable direction of the movable member 100 in design (the Z direction) and the normal direction N1 of the sound board 7 becomes different from the designed target angle (e.g., zero degrees in the present embodiment). That is, when the axis C2 of the rod-like portion 101 is inclined with inclination of the other-end-portion coupling portion 110, the angle between the axis C2 and the axis C1 of the magnetic-path definer 52 is not appropriate, that is, the angle becomes different from zero degrees in design. In this case, the relationship between the electromagnetic engaging portion EM and the magnetic-path definer 52 may become inappropriate, leading to generation of an excessive force between the electromagnetic engaging portion EM and the magnetic-path definer 52. The angle of the normal direction N1 of the sound board 7 and the axis C1 of the magnetic-path definer 52 becomes different from the target angle in some cases due to a manufacturing error or a mounting error in a configuration extending from the magnetic-path definer 52 to the straight pole 9 via the driver supporters 60 and the support member 55.

Accordingly, there is a need of a function for absorbing a force which makes the angle between the normal direction N1 and the axis C1 inappropriate and which is generated due to movement or deformation of the sound board 7, or a manufacturing error or a mounting error in components. This function keeps appropriate electromagnetic engagement between the magnetic-path definer 52 and the electromagnetic engaging portion EM and enables appropriate transmission of the vibration of the movable member 100 to the sound board 7. Thus, the present embodiment focuses on the angle between the normal direction N1 of the sound board 7 and the movable direction of the movable member 100 (the direction in which the axis C1 of the magnetic-path definer 52 extends). The piano 1 includes the driver supporter 60 configured to support the magnetic-path definer 52 such that the magnetic-path definer 52 is pivotable about the axis C3 that extends in a direction intersecting (e.g., orthogonal to) the movable direction. The driver supporter 60 is an intervening portion located between the support member 55 and the magnetic-path definer 52 as the driver. The vibrator is constituted by the vibrating member 50 and the driver supporter 60.

Figure 5:
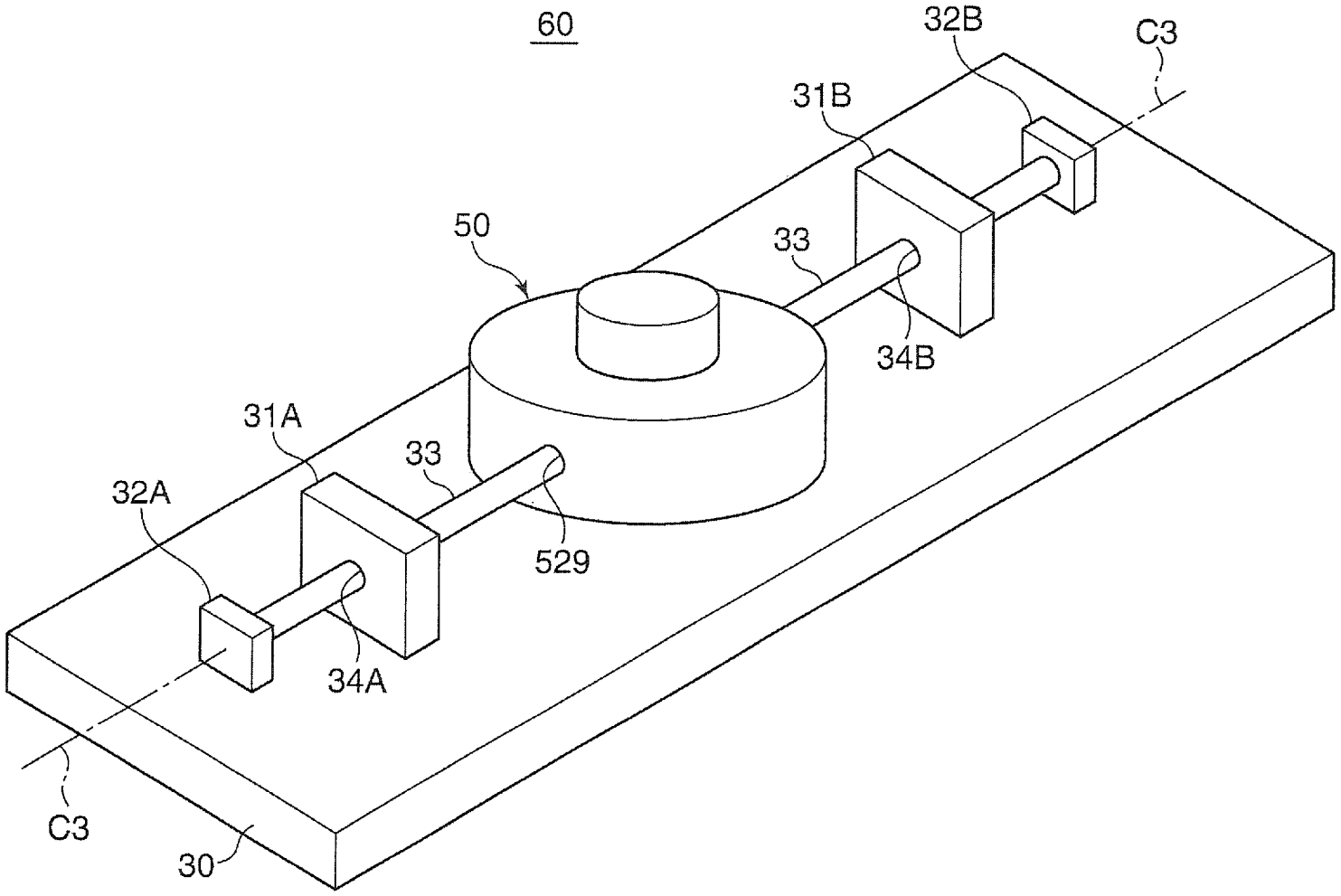
FIG. 5 is a schematic perspective view of the vibrator including a driver supporter.
Figure 6:
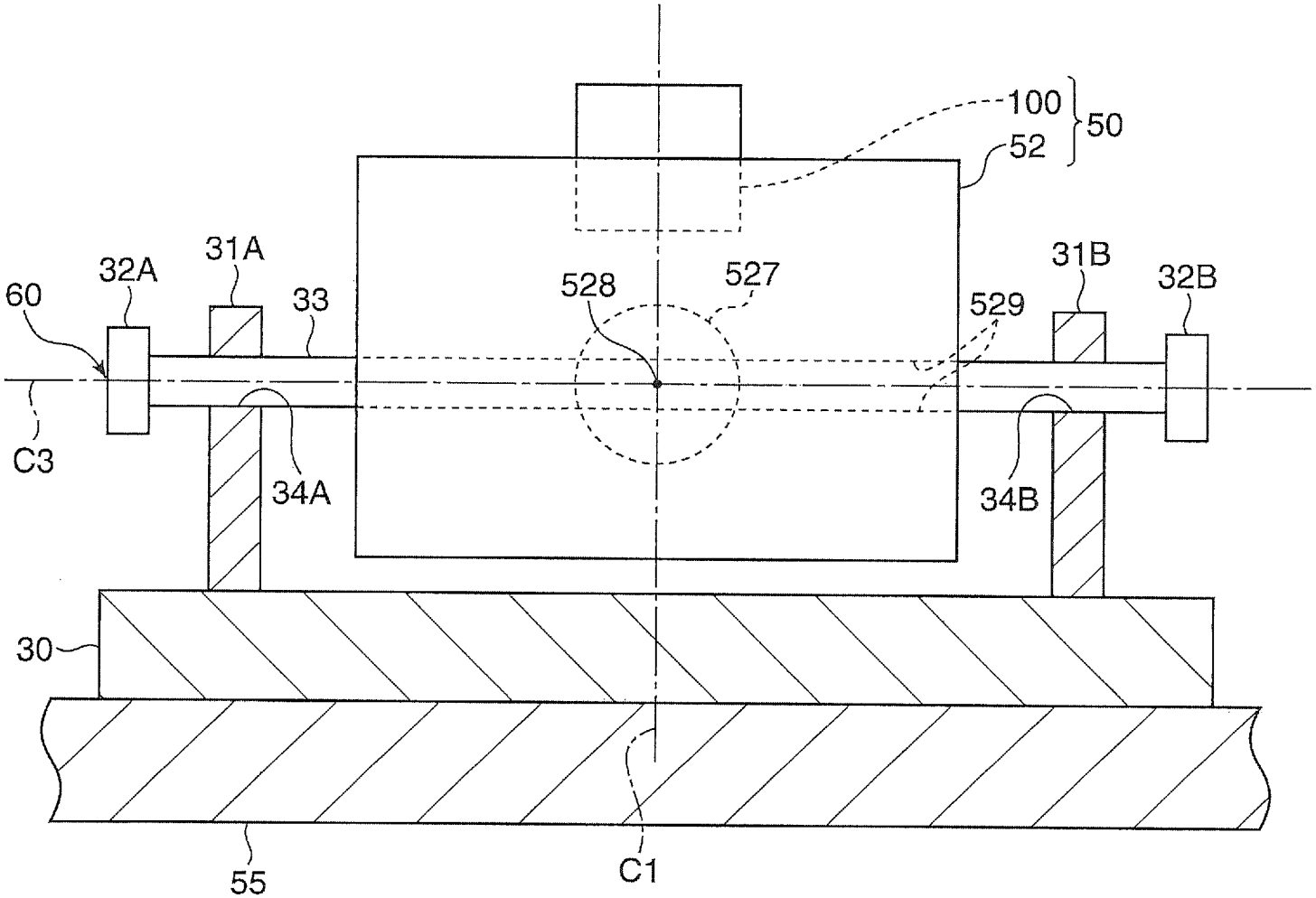
FIG. 6 is a schematic elevational view in vertical cross section illustrating the vibrator including the driver supporter.

FIGS. 5 and 6 are a schematic perspective view and a schematic elevational view in vertical cross section illustrating the vibrator including the driver supporters 60. Since the following description focuses on the driver supporter 60, FIGS. 5 and 6 simplify illustration of the shape of the vibrating member 50 including the movable member 100 and the magnetic-path definer 52. Accordingly, illustration of the shape of the vibrating member 50 is different between FIG. 4 and FIGS. 5 and 6, but the same reference numerals indicate the same components.

The magnetic-path definer 52 has an insertion hole 529 (FIGS. 4-6). A shaft 33 is inserted in the insertion hole 529. The direction in which the insertion hole 529 extends is substantially orthogonal to the axis C1 of the magnetic-path definer 52. Accordingly, the axis C3 of the shaft 33 is substantially orthogonal to the axis C1. The shaft 33 is rotatably supported in the insertion hole 529 and slidable with respect to the insertion hole 529 in a direction in which the axis C3 extends (hereinafter may be referred to as "axis-C3 direction").

A base member 30 of the driver supporter 60 is secured to the support member 55. A pair of shaft supporters 31A, 31B are secured to and protrude from the base member 30. The shaft 33 is supported by the shaft supporters 31A, 31B. That is, the shaft supporters 31A, 31B have shaft support holes 34A, 34B, respectively. The shaft 33 is pivotably supported by the shaft support holes 34A, 34B so as to be slidable in the axis-C3 direction. Each of opposite end portions of the shaft 33 extends from a corresponding one of the shaft supporters 31A, 31B through a corresponding one of the shaft support holes 34A, 34B. A stopper 32A is secured to the end portion of the shaft 33 which is supported by the shaft supporter 31A. A stopper 32B is secured to the end portion of the shaft 33 which is supported by the shaft supporter 31B. When the shaft 33 moves in the axis-C3 direction, the stopper 32A comes into contact with the shaft supporter 31A, or the stopper 32B comes into contact with the shaft supporter 31B, thereby limiting the moving range of the shaft 33. This configuration prevents the shaft 33 from coming out of the shaft support holes 34A, 34B. Providing the stopper 32A, 32B is not essential.

The axis C3 extends through a position near the center 528 of gravity of the vibrating member 50 constituted by the magnetic-path definer 52 and the movable member 100 (see FIG. 6). When the axis C3 is spaced apart from the center 528 of gravity, rotation moment is generated by the weight of the vibrating member 50. When this rotation moment becomes excessively large, load is always applied to the other-end-portion coupling portion 110. Thus, the axis C3 preferably extends through a position as near the center 528 of gravity as possible and preferably extends through a region of a sphere shape 527 centered about the center 528 of gravity. This configuration avoids heavy load caused by the rotation moment from being imposed on the other-end-portion coupling portion 110 and the vibrating member 50. The diameter of the sphere shape 527 is within 20% of the largest dimension of the vibrating member 50, for example.

The shaft supporters 31A, 31B are respectively held at positions spaced apart from the axis C1 of the magnetic-path definer 52 in the axis-C3 direction. That is, as illustrated in FIG. 6, the shaft 33 is supported by (i) the shaft supporter 31A located on one side (the left side in FIG. 6) of the magnetic-path definer 52 in the axis-C3 direction and (ii) the shaft supporter 31B located on the other side (the right side in FIG. 6) of the magnetic-path definer 52 in the axis-C3 direction. From another viewpoint, the shaft supporters 31A, 31B are respectively located on opposite sides of an imaginary plane containing the center 528 of gravity and orthogonal to the axis C3. This arrangement increases the accuracy of the angle of the axis C3 and disperses load for holding the magnetic-path definer 52.

With the configuration described above, the vibrating member 50 is pivotable with respect to the shaft supporters 31A, 31B via the shaft 33 and movable in the axis-C3 direction. Thus, the vibrating member 50 acts as follows. The designed movable direction of the movable member 100 is the Z direction. It is assumed that at least one of the angle between the normal direction N1 and the Z direction and the angle between the axis C1 and the Z direction is larger than a designed value (zero degrees) with respect to a direction orthogonal to the Z direction and the axis C3. That is, the angle between the normal direction N1 and the Z direction or the angle between the axis C1 and the Z direction becomes different from the target angle in the direction orthogonal to the Z direction and the axis C3. However, the vibrating member 50 pivots about the axis C3 to absorb the difference in the angle, so that the normal direction N1 and the axis C1 become substantially parallel with each other. Since the normal direction N1 and the axis C1 become substantially parallel with each other, it is possible to appropriately maintain the positional relationship between the movable member 100 and the magnetic-path definer 52. This improves the durability of the vibrating member 50.

It is assumed that the other-end-portion coupling portion 110 is moved in the axis-C3 direction by movement of the sound board 7 in a direction (the horizontal direction) orthogonal to the Z direction. In this case, the vibrating member 50 moves in the axis-C3 direction relative to the driver supporter 60 by sliding of the shaft 33 with respect to the shaft support holes 34A, 34B or sliding of the shaft 33 and the insertion hole 529 relative to each other. This movement absorbs the movement of the other-end-portion coupling portion 110, so that the normal direction N1 and the axis C1 become substantially parallel with each other. Accordingly, it is possible to appropriately maintain the positional relationship between the movable member 100 and the magnetic-path definer 52.

In the present embodiment, the driver supporter 60 is secured to the support member 55 and supports the magnetic-path definer 52 such that the magnetic-path definer 52 is pivotable about the axis C3 intersecting the movable direction of the movable member 100. Thus, pivotal movement of the magnetic-path definer 52 reduces the difference between (i) the angle between the normal direction N1 and the axis C1 and (ii) the target angle. As a result, it is possible to appropriately maintain the positional relationship between the movable member 100 and the magnetic-path definer 52, making it difficult for an excessive force to act between the movable member 100 and the magnetic-path definer 52 and between the sound board 7 and the movable member 100. This improves the durability of the vibrating member 50. Accordingly, it is possible to appropriately maintain a vibrating function of the vibrating member 50 with respect to the sound board 7.

The driver supporter 60 supports the magnetic-path definer 52 such that the magnetic-path definer 52 is movable in the axis-C3 direction, making it possible to also absorb the movement of the sound board 7 in the axis-C3 direction. This improves the durability of the vibrating member 50.

It is noted that, in the case where the direction in which the sound board 7 inclines and the direction in which the sound board 7 moves horizontally are identified in advance by, e.g., characteristics of the sound board 7, the axis-C3 direction may be set in accordance with the directions. That is, the piano 1 may be designed such that the direction in which the sound board 7 inclines and the axis C3 are substantially orthogonal to each other, and the direction in which the sound board 7 moves horizontally and the axis C3 are substantially parallel with each other. It is noted that the base member 30 may be supported by the support member 55 so as to be pivotable about the Z direction. For example, a rotation table is disposed between the base member 30 and the support member 55. This configuration can deal with a case where the direction in which the sound board 7 inclines and the direction in which the sound board 7 moves horizontally are not identified.

In the present embodiment, the shaft 33 is pivotable with respect to the shaft support holes 34A, 34B and the insertion hole 529 and slidable in the axis-C3 direction. However, the shaft 33 may be pivotable with respect to the shaft support holes 34A, 34B or the insertion hole 529 and slidable in the axis-C3 direction. That is, the shaft 33 may be secured to the shaft supporters 31A, 31B or the magnetic-path definer 52.

In the case where a principal object is to eliminate the difference between (i) the angle between the normal direction N1 and the axis C1 and (ii) the target angle, it is not essential that the vibrating member 50 is movable relative to the driver supporter 60 in the axis-C3 direction. From this viewpoint, the shaft 33 may be pivotable with respect to the shaft support holes 34A, 34B or the insertion hole 529 but not movable in the axis-C3 direction.

Second Embodiment

Figure 7:
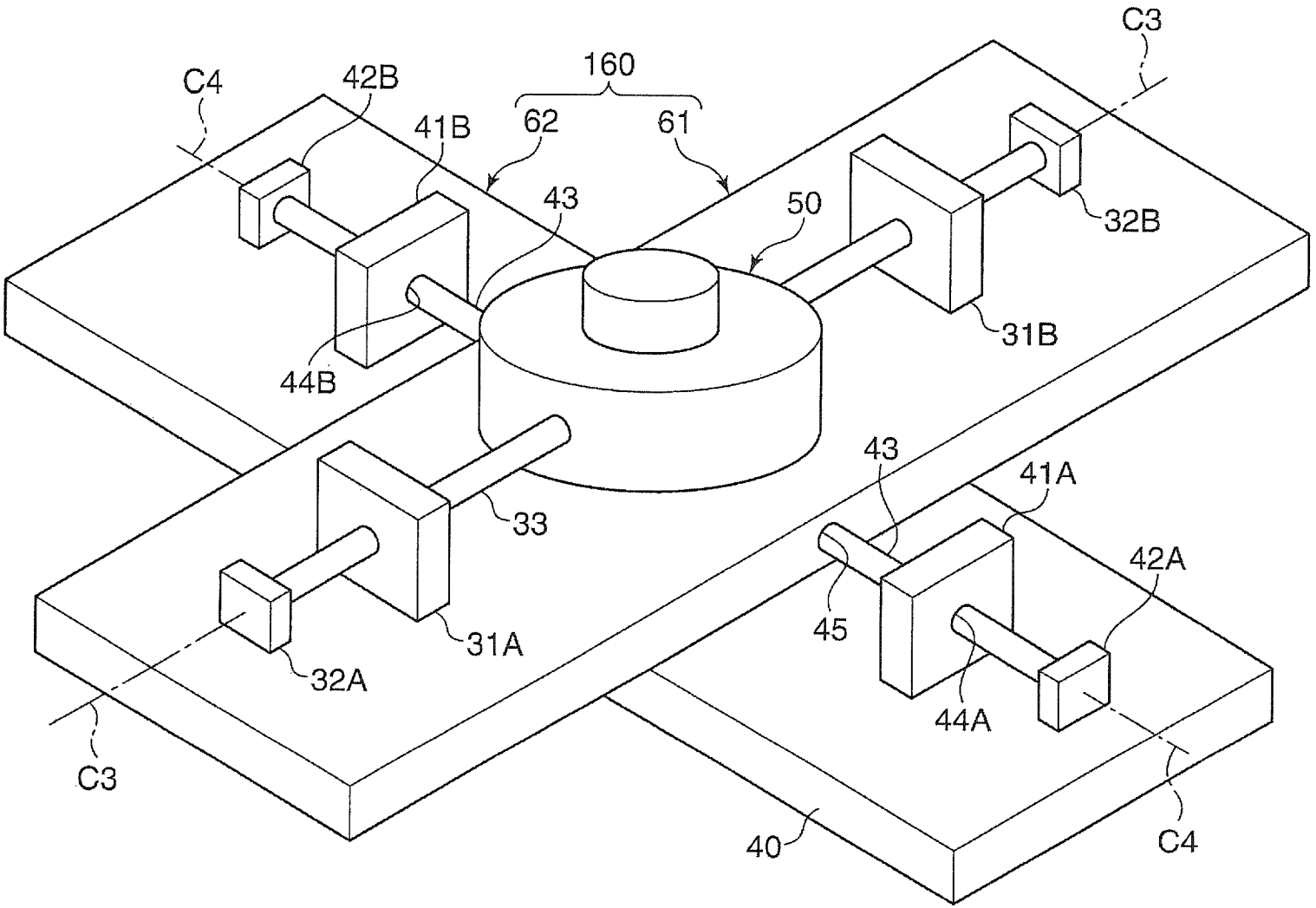
FIG. 7 is a schematic perspective view of a vibrator including a driver supporter according to a second embodiment.

FIG. 7 is a schematic perspective view of a vibrator including a driver supporter according to a second embodiment. In the present embodiment, a first driver supporter 61 corresponding to the driver supporter 60 (FIG. 5) in the first embodiment is provided, and a second driver supporter 62 is disposed between the base member 30 of the first driver supporter 61 and the support member 55. Thus, a driver supporter 160 is constituted by the first driver supporter 61 and the second driver supporter 62. The configuration of the first driver supporter 61 is similar to that of the driver supporter 60 except for a relationship between the base member 30 and the support member 55. The first driver supporter 61 has an insertion hole 45 corresponding to the insertion hole 529.

The second driver supporter 62 includes a base member 40, stoppers 42A, 42B, and a shaft 43 (as one example of another shaft) corresponding respectively to the base member 30, the stopper 32A, 32B, and the shaft 33 of the first driver supporter 61. The second driver supporter 62 includes a pair of shaft supporters 41A, 41B corresponding to the pair of shaft supporters 31A, 31B of the first driver supporter 61. Each of the base member 30 and the pair of shaft supporters 31A, 31B is one example of a first shaft supporter. Each of the base member 40 and the pair of shaft supporters 41A, 41B is one example of a second shaft supporter.

The shaft 43 is inserted in the insertion hole 45. The direction in which the insertion hole 45 extends is substantially orthogonal to the axis C1 of the magnetic-path definer 52 and the axis C3. Thus, the axis C4 of the shaft 43 as one example of another axis is substantially orthogonal to the axis C1 and the axis C3. The shaft 43 is rotatably supported by the insertion hole 45 so as to be slidable with respect to the insertion hole 45 in a direction in which the axis C4 extends (hereinafter may be referred to as "axis-C4 direction").

The base member 40 is secured to the support member 55. A pair of shaft supporters 41A, 41B are secured to and protrude from the base member 40. The shaft 43 is supported by the shaft supporters 41A, 41B. The shaft supporters 41A, 41B have shaft support holes 44A, 44B, respectively. The shaft 43 is pivotably supported by the shaft support holes 44A, 44B so as to be slidable in the axis-C4 direction. Each of opposite end portions of the shaft 43 extends from a corresponding one of the shaft supporters 41A, 41B through a corresponding one of the shaft support holes 44A, 44B. The stopper 42A is secured to the end portion of the shaft 43 which is supported by the shaft supporter 41A. The stopper 42B is secured to the end portion of the shaft 43 which is supported by the shaft supporter 41B. When the shaft 43 moves in the axis-C4 direction, the stopper 42A comes into contact with the shaft supporter 41A, or the stopper 42B comes into contact with the shaft supporter 41B, thereby limiting the moving range of the shaft 43. This configuration prevents the shaft 43 from coming out of the shaft support holes 44A, 44B. Providing the stoppers 42A, 42B is not essential.

The axis C4 extends through a position near the center 528 of gravity of the vibrating member 50. The axis C4 preferably extends through a region within 20% of the largest dimension of the vibrating member 50 centered about the center 528 of gravity. The shaft supporters 41A, 41B are respectively held at positions spaced apart from the axis C1 of the magnetic-path definer 52 in the axis-C4 direction. From another viewpoint, the shaft supporters 41A, 41B are respectively located on opposite sides of an imaginary plane containing the center 528 of gravity and orthogonal to the axis C4. This arrangement increases the accuracy of the angle of the axis C4 and disperses load for holding the magnetic-path definer 52.

With the configuration described above, the vibrating member 50 is pivotable with respect to the shaft supporters 31A, 31B via the shaft 33 and movable in the axis-C3 direction. Furthermore, the vibrating member 50 is pivotable with respect to the shaft supporters 41A, 41B via the shaft 43 and movable in the axis-C4 direction.

It is assumed that at least one of the angle between the normal direction N1 and the Z direction and the angle between the axis C1 and the Z direction is larger than a designed value (zero degrees) with respect to a direction orthogonal to the Z direction and the axis C4. That is, the angle between the normal direction N1 and the Z direction or the angle between the axis C1 and the Z direction becomes different from the target angle in the direction orthogonal to the Z direction and the axis C4. However, the vibrating member 50 pivots about the axis C4 to absorb the difference in the angle, so that the normal direction N1 and the axis C1 become substantially parallel with each other in the direction orthogonal to the Z direction and the axis C4.

In addition, as described above, the function of the first driver supporter 61 makes the normal direction N1 and the axis C1 substantially parallel with each other in the direction orthogonal to the Z direction and the axis C3. Accordingly, the normal direction N1 and the axis C1 become substantially parallel with each other regardless of the direction of the difference in the angle. Since the normal direction N1 and the axis C1 become substantially parallel with each other, it is possible to appropriately maintain the positional relationship between the movable member 100 and the magnetic-path definer 52.

It is assumed that the other-end-portion coupling portion 110 is moved in the axis-C4 direction by movement of the sound board 7 in the direction (the horizontal direction) orthogonal to the Z direction. In this case, the vibrating member 50 moves in the axis-C4 direction relative to the driver supporter 60 by sliding of the shaft 43 with respect to the shaft support holes 44A, 44B or sliding of the shaft 43 and the insertion hole 45 relative to each other. This movement absorbs the movement of the other-end-portion coupling portion 110, so that the normal direction N1 and the axis C1 become substantially parallel with each other. Accordingly, it is possible to appropriately maintain the positional relationship between the movable member 100 and the magnetic-path definer 52.

In the present embodiment, the driver supporter 160 supports the magnetic-path definer 52 such that the magnetic-path definer 52 is pivotable about the axis C3 and pivotable about the axis C4. This configuration reduces the difference between (i) the angle between the normal direction N1 and the axis C1 and (ii) the target angle, not only in a direction orthogonal to the movable direction of the movable member 100 and the axis C3 but also in a direction orthogonal to the movable direction and the axis C4. Also, it is possible to absorb not only the movement of the sound board 7 in the axis-C3 direction but also the movement of the sound board 7 in the axis-C4 direction. This improves the durability of the vibrating member 50.

In particular, since the axis C3 and the axis C4 are substantially orthogonal to each other, it is possible to sufficiently deal with the case where the direction in which the sound board 7 inclines and the direction in which the sound board 7 moves horizontally are not identified.

In the present embodiment, the shaft 43 is pivotable with respect to the shaft support holes 44A, 44B and the insertion hole 45 and slidable in the axis-C4 direction. However, the shaft 43 may be pivotable with respect to the shaft support holes 44A, 44B or the insertion hole 45 and slidable in the axis-C4 direction. That is, the shaft 43 may be secured to the shaft supporters 41A, 41B or the base member 30 of the first driver supporter 61.

In the case where a principal object is to eliminate the difference between (i) the angle between the normal direction N1 and the axis C1 and (ii) the target angle, it is not essential that the vibrating member 50 is movable relative to the driver supporter 60 in the axis-C4 direction. From this viewpoint, the shaft 43 may be pivotable with respect to the shaft support holes 44A, 44B or the insertion hole 45 but not movable in the axis-C4 direction.

Figure 8:
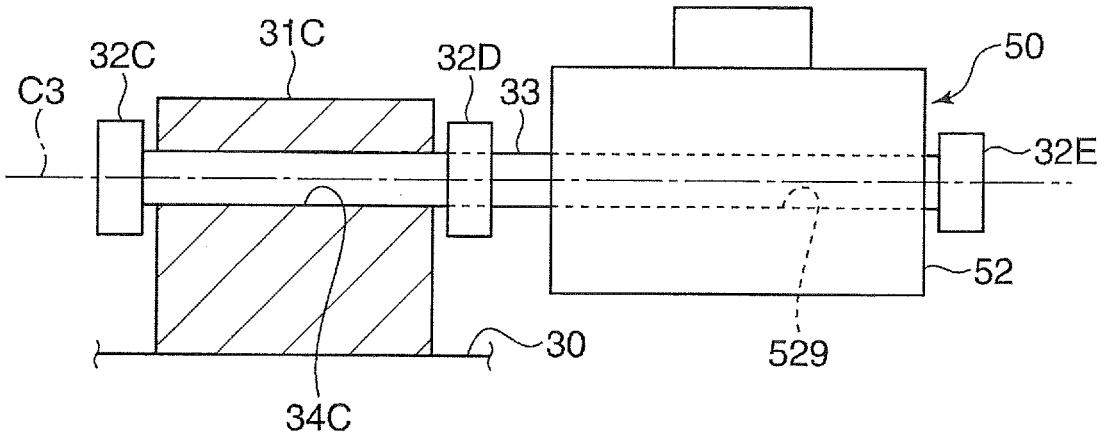
FIG. 8 is a schematic elevational view in vertical cross section illustrating a vibrator according to a modification.

In the first and second embodiments, the shaft 33 is supported at its opposite end portions by the respective shaft supporters 31A, 31B. However, as illustrated in a modification in FIG. 8, the shaft 33 may be supported at its one end portion. FIG. 8 is a schematic elevational view in vertical cross section illustrating a vibrator according to the modification. FIG. 8 omits illustration of the support member 55.

A shaft supporter 31C is secured to and protrudes from the base member 30. The shaft 33 is supported in a shaft support hole 34C of the shaft supporter 31C pivotably and slidably in the axis-C3 direction. Stoppers 32C, 32D are secured to the shaft 33 respectively on opposite sides of the shaft supporter 31C in the axis-C3 direction. The shaft 33 is inserted in the insertion hole 529 of the magnetic-path definer 52. A stopper 32E is secured to an end portion of the shaft 33 which protrudes from the magnetic-path definer 52 in a direction away from the shaft supporter 31C in the axis-C3 direction. When the shaft 33 moves in the axis-C3 direction, a stopper 32C or a stopper 32D comes into contact with the shaft supporter 31C, thereby limiting the moving range of the shaft 33. The stopper 32E contacts the magnetic-path definer 52, thereby preventing the shaft 33 from coming out of the insertion hole 529. Providing the stoppers 32C, 32D, 32E is not essential.

In view of the above, even in the case where the shaft 33 is supported at its one end portion, it is possible to stably support the vibrating member 50 as long as the shaft support hole 34C has a sufficient length. It is noted that the shaft 43 in the second embodiment may have a configuration similar to the configuration in which the shaft 33 is supported at its one end portion. It is noted that each of the shafts 33, 43 may be supported substantially at three positions.

Figure 9:
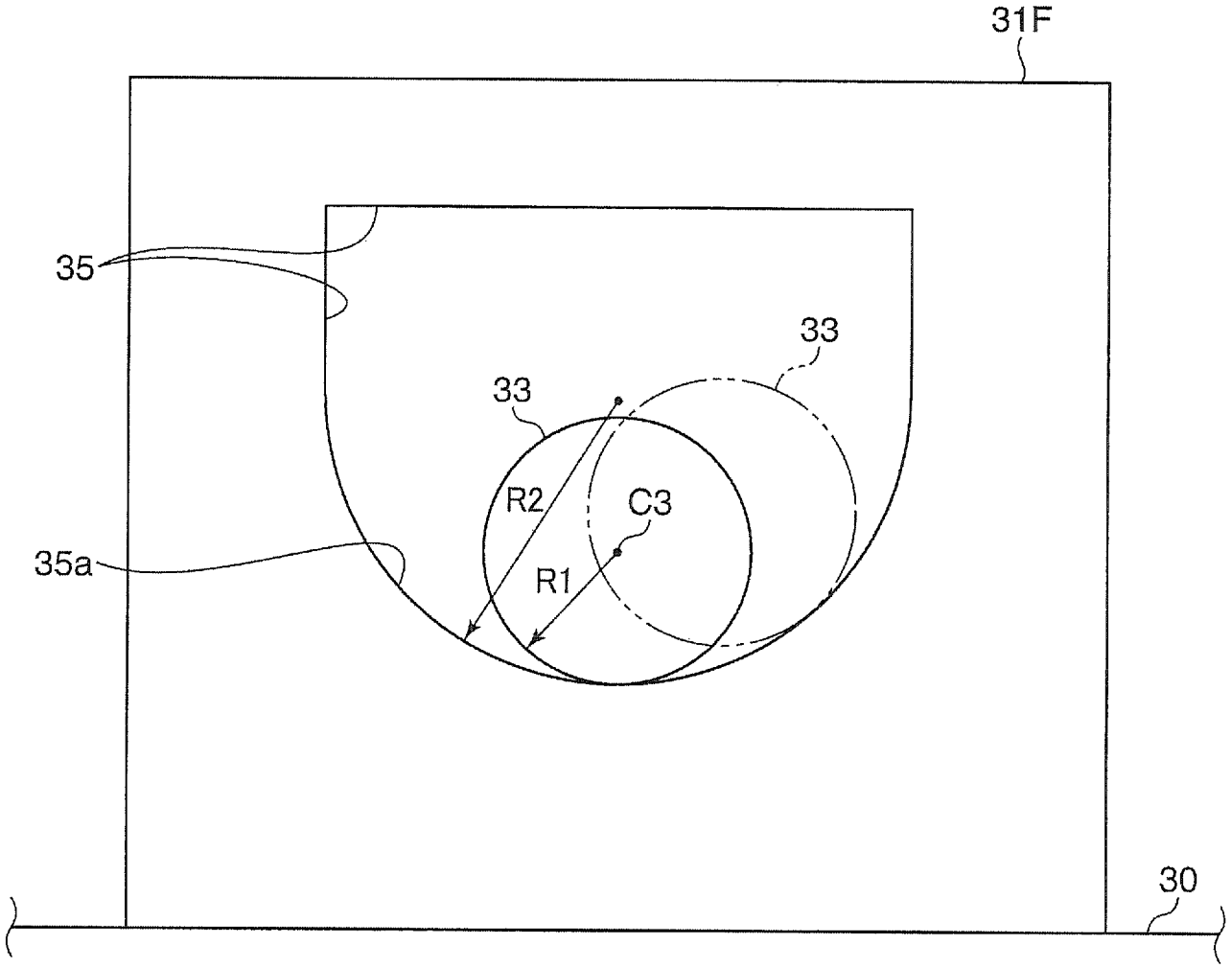
FIG. 9 is a schematic view representing a relationship between a shaft supporter and a shaft in another modification.

In the first and second embodiments, the circular cylindrical shaft 33 is held in the round shaft support holes 34A, 34B, and the circular cylindrical shaft 43 is held in the round shaft support holes 44A, 44B. As illustrated in FIG. 9, however, a configuration in which each of the shafts 33, 43 substantially pivots by rolling may be employed.

FIG. 9 is a schematic view representing a relationship between the shaft 33 and a shaft supporter 31F in a modification. FIG. 9 is a view seen in the axis-C3 direction. While FIG. 9 illustrates a configuration for supporting the shaft 33 by way of example, this configuration may be applied to a configuration for supporting the shaft 43. Thus, a pair of the shaft supporters 31F may be employed in the first embodiment instead of the shaft supporters 31A, 31B. A pair of the shaft supporters 31F may be employed in the first and second embodiments instead of the shaft supporter 31C or employed in the second embodiment instead of the shaft supporters 41A, 41B.

As illustrated in FIG. 9, the shaft supporter 31F has a hole 35 through which the shaft 33 is inserted. A lower half portion of the hole 35 is an arc portion 35*a* having a substantially semicircular shape. This configuration allows the shaft 33 to roll in the arc portion 35*a*. The curvature radius R2 of the arc portion 35*a* is greater than the radius R1 of the shaft 33. When the angle between the normal direction N1 and the axis C1 is about to become different from the target angle, the shaft 33 rolls in the arc portion 35*a* to a position at which the difference in the angle is absorbed. This configuration also appropriately maintains the positional relationship between the movable member 100 and the magnetic-path definer 52, thereby improving the durability of the vibrating member 50. Moreover, when the shaft 33 pivots, a larger force is generated between the shaft 33 and the hole 35 due to rolling friction than due to sliding friction, resulting in smaller pivot resistance.

It is noted that a recessed curved surface may be employed instead of the arc portion 35*a*. The shaft 33 may have a protruding curved surface engageable with the arc portion 35*a* or the recessed curved surface, instead of having a round surface in cross section. In the case where both of the protruding curved surface and the recessed curved surface are employed, the curvature radius of the recessed curved surface is set to be greater than that of the protruding curved surface.

It is noted that the shaft support holes 34A, 34B, 34C, 44A, 44B may open upward in the above-described embodiments. Likewise, the hole 35 in the modification illustrated in FIG. 9 may open upward. With this configuration, only movement in a down direction is limited in each of the shafts 33, 43 among movements in the components of the Z direction. An urging force due to gravity always acts in a direction in which a protrusion (e.g., the protruding curved surface of the shaft 33) and a recession (e.g., the arc portion 35*a* or the recessed curved surface) contact with each other.

It is noted that each of the protrusion and the recession may always be urged not by gravity but by a preset force, such as a spring force or a magnetic force, in the direction in which the protrusion and the recession contact each other. By setting a driving force of the movable member 100 in a range sufficiently smaller than the above-described urging force, it is possible to always keep the protrusion and the recession in contact with each other, that is, it is possible to achieve a structure in which the shaft 33 is supported at its one end portion. This configuration reduces occurrences of noise (grating noise) near a position at which the protrusion and the recession are in contact with each other. Furthermore, a restricting mechanism for preventing the protrusion and the recession from separating from each other (e.g., a wall located near the protrusion and provided for preventing separation of the protrusion from the recession) need not be provided, thereby simplifying the configuration of the shaft supporter.

While each of the direction in which the axis C3 extends and the direction in which the axis C4 extends is substantially orthogonal to the movable direction of the movable member 100 (the Z direction) in the above-described embodiments, the present disclosure is not limited to this configuration. Each of the direction in which the axis C3 extends and the direction in which the axis C4 extends at least needs to coincide with a direction intersecting the movable direction. While the axis C3 and the axis C4 are substantially orthogonal to each other, the present disclosure is not limited to this configuration. The axis C3 and the axis C4 at least need to intersect each other.

It is noted that the musical instrument to which the present disclosure is applied is not limited to a keyboard instrument such as a piano. For example, the present disclosure is applied to acoustic musical instruments including a vibrating member, electronic musical instruments including a vibrating member, or speakers. The present disclosure may be applied to apparatuses in which (i) a position on the vibratable member at which the vibratable member is coupled to the movable portion and (ii) a support position of the vibrating member become different from each other by changes in dimension, for example. For example, the present disclosure may be applied to a stringed musical instrument illustrated in FIG. 10. The present disclosure may be applied to percussion instruments as automatic playing devices such as drums.

Figure 10:
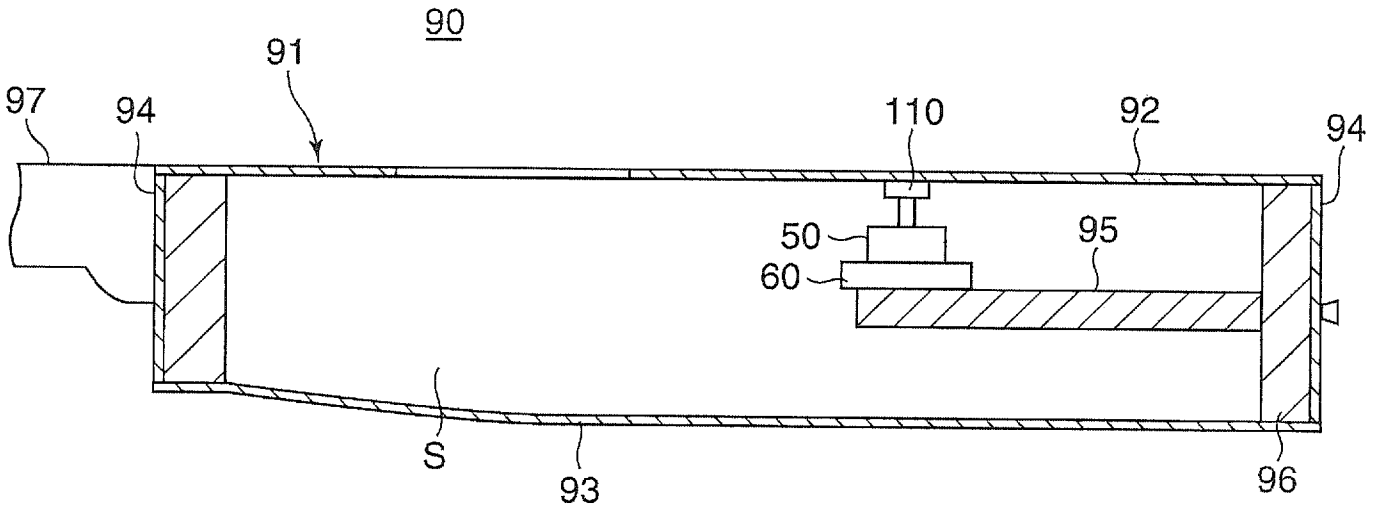
FIG. 10 is a schematic cross-sectional view of a stringed musical instrument to which the present disclosure may be applied.

FIG. 10 is a schematic cross-sectional view of a stringed musical instrument to which the present disclosure is applicable. The stringed musical instrument is provided as a guitar 90, for example. The guitar 90 includes a body 91 and a neck 97. The body 91 includes a top board 92, a back board 93, and a side plate 94 which form an inner space S. In the inner space S, an end block 96 is secured to the side plate 94. A support member 95 corresponding to the support member 55 is secured to the end block 96. The driver supporter 60 is secured to the support member 95. The top board 92 is a vibratable member corresponding to the sound board 7. The configuration of the vibrating member 50 is any of is configurations in the above-described embodiments. The other-end-portion coupling portion 110 of the movable member 100 is secured to a back surface of the top board 92. The movable direction of the movable member 100 coincides with the thickness direction of the top board 92. The driver supporter 160 may be employed instead of the driver supporter 60.

It is noted that the sound board 7 and the top board 92 are provided as examples of the vibratable member, the present disclosure is not limited to this configuration. The present disclosure may also be applied to a case where a member deformable and changeable in dimension, such as a roof and a side plate, is employed as the vibratable member.

While the embodiments have been described above, it is to be understood that the disclosure is not limited to the details of the illustrated embodiments, but may be embodied with various changes and modifications, which may occur to those skilled in the art, without departing from the spirit and scope of the disclosure. Portions of the above-described embodiments may be combined as needed.

What is claimed is:

1. A vibrator for use in a musical instrument to produce a sound, the vibrator comprising:

a movable portion configured to be vibratable and connected to a vibratable member such that vibration of the movable portion causes the vibratable member to vibrate;

a driver configured to drive the movable portion to cause the vibration of the movable portion to thereby vibrate the vibratable member, thereby producing the sound due to the vibration of the vibratable member; and a driver supporter secured to a support member and having an axis member (i) that has an axis extending in a direction intersecting a movable direction of the movable portion and (ii) that is configured to support the driver such that the driver is pivotable about the axis extending in the direction intersecting the movable direction of the movable portion.

2. The vibrator according to claim 1, wherein the driver supporter is configured to support the driver in at least two positions.

3. The vibrator according to claim 1, wherein the driver supporter is configured to support the driver such that the driver is pivotable about the axis and about another axis that intersects the movable direction of the movable portion and the axis.

4. The vibrator according to claim 1, wherein the axis extends through a center of gravity of a vibrating member comprising the movable portion and the driver.

5. The vibrator according to claim 1, wherein the axis extends through a region of a vibrating member defined by a sphere centered on a center of gravity of the vibrating member and having a diameter that is 20% or less of a largest dimension of the vibrating member, and the vibrating member comprises the movable portion and the driver.

6. The vibrator according to claim 1, wherein the driver supporter is configured to support the driver such that the driver is movable in the direction in which the axis extends.

7. The vibrator according to claim 1, wherein the axis, about which the driver is pivotable, extends orthogonally to the movable direction of the movable portion.

8. A vibrator for use in a musical instrument to produce a sound, the vibrator comprising:

a movable portion configured to be vibratable and connected to a vibratable member such that vibration of the movable portion causes the vibratable member to vibrate;

a driver configured to drive the movable portion to cause the vibration of the movable portion to thereby vibrate the vibratable member, thereby producing the sound due to the vibration of the vibratable member;

a shaft supporter secured to a support member; and a shaft having an axis extending in a direction and being connected to the shaft supporter and the driver such that the direction in which the axis of the shaft extends intersects a movable direction of the movable portion, the shaft being pivotable with respect to at least one of the shaft supporter and the driver.

9. The vibrator according to claim 8, wherein the shaft supporter is configured to support the shaft in at least two positions.

10. The vibrator according to claim 8, wherein the shaft supporter comprises a first shaft supporter, a second shaft supporter secured to the support member, and another shaft, wherein the shaft is connected to the first shaft supporter and the driver such that the direction in which the axis of the shaft extends coincides with the direction intersecting the movable direction of the movable portion, wherein the shaft is pivotable with respect to at least one of the first shaft supporter and the driver, wherein said another shaft is connected to the first shaft supporter and the second shaft supporter such that a direction in which another axis of the shaft extends intersects the movable direction of the movable portion and the axis of the shaft, and wherein said another shaft is pivotable with respect to at least one of the first shaft supporter and the second shaft supporter.

11. The vibrator according to claim 8, wherein the axis of the shaft extends through a position located in a vicinity of a center of gravity of a vibrating member comprising the movable portion and the driver.

12. The vibrator according to claim 8, wherein the shaft supporter supports the shaft such that the shaft is movable in the direction in which the axis of the shaft extends.

13. The vibrator according to claim 8, wherein the shaft supporter comprises a recessed curved surface that receives the shaft, wherein the shaft has a round shape in cross section or comprises a protruding curved surface engageable with the recessed curved surface, and wherein a curvature radius of the recessed curved surface is greater than a radius of the shaft or a curvature radius of the protruding curved surface.

14. The vibrator according to claim 8, wherein the driver comprises an insertion hole in which the shaft is inserted.

15. The vibrator according to claim 8, wherein the shaft supporter is configured to support the shaft as a pair of shaft supporters respectively in two positions spaced apart from an axis of the driver in a direction in which the axis of the shaft extends.

16. The vibrator according to claim 15, wherein the pair of shaft supporters respectively comprise shaft support holes in which the shaft is inserted, and wherein opposite end portions of the shaft extend respectively from the pair of shaft supporters respectively through the shaft support holes.

17. The vibrator according to claim 8, wherein the direction in which the axis of the shaft extends is orthogonal to the movable direction of the movable portion.

18. A musical instrument, comprising:

a vibrator comprising (i) a movable portion connected to a vibratable member, (ii) a driver configured to drive the movable portion to cause vibration of the movable portion to vibrate the vibratable member, and (iii) a driver supporter secured to a support member and configured to support the driver such that the driver is pivotable about an axis extending in a direction intersecting a movable direction of the movable portion;

a sound board as the vibratable member to which the movable portion is connected; and the support member to which the driver supporter is secured.

* * * * *